United States Patent [19]

Achelpohl

[11] 4,452,597

[45] Jun. 5, 1984

[54] METHOD AND APPARATUS FOR FORMING STACKS OF SACKS

[75] Inventor: Fritz Achelpohl, Lengerich of Westphalia, Fed. Rep. of Germany

[73] Assignee: Windmöller & Hölscher, Lengerich, Fed. Rep. of Germany

[21] Appl. No.: 351,625

[22] Filed: Feb. 24, 1982

[30] Foreign Application Priority Data

Feb. 26, 1981 [DE] Fed. Rep. of Germany ..... 3107287

[51] Int. Cl.[3] ..... B31B 23/02

[52] U.S. Cl. ..... 493/204; 493/444

[58] Field of Search ..... 493/204, 203, 444, 445; 83/86, 90; 226/113, 114; 156/515

[56] References Cited

U.S. PATENT DOCUMENTS

| | | | |
|---|---|---|---|
| 2,925,119 | 2/1960 | Jaquiery | 493/204 X |
| 3,074,710 | 1/1963 | Olson | 493/444 X |
| 3,863,549 | 2/1975 | Melin et al. | 493/204 X |
| 3,905,593 | 9/1975 | Behn | 493/444 X |
| 4,183,515 | 1/1980 | Coast | 493/444 |
| 4,317,656 | 3/1982 | Schulze et al. | 493/204 X |

FOREIGN PATENT DOCUMENTS

| | | | |
|---|---|---|---|
| 1054818 | 4/1959 | Fed. Rep. of Germany | 493/204 |

*Primary Examiner*—James F. Coan

*Attorney, Agent, or Firm*—Fleit, Jacobson, Cohn & Price

[57] ABSTRACT

In a method of stacking sacks of thermoplastic film, the sacks are successively deposited on each other and formed with internested loops of progressively shallower depth.

19 Claims, 1 Drawing Figure

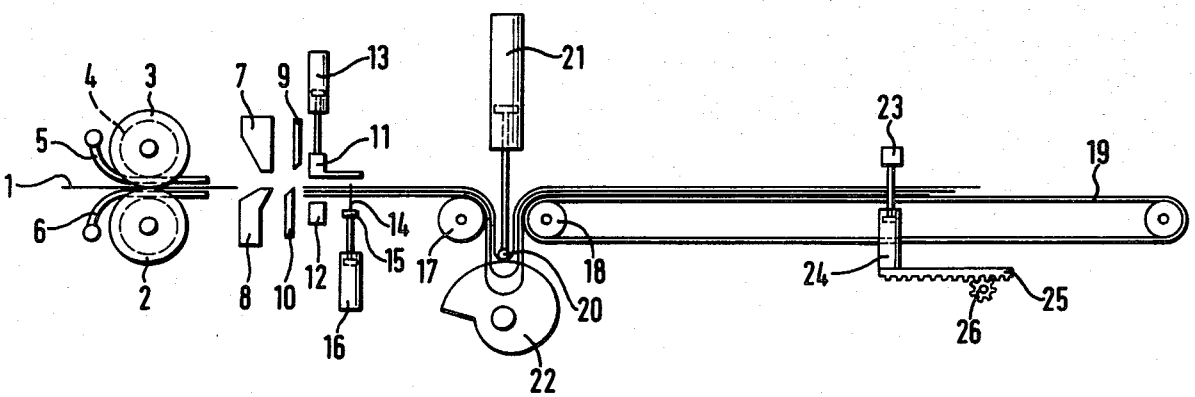
1
2
3
4
5
6
7
8
9
10
11
12
13
14
15
16
17
18
19
20
21
22
23
24
25
26

METHOD AND APPARATUS FOR FORMING STACKS OF SACKS

The invention relates to a method of forming stacks from sacks each having at one end a base closed by a transverse weld seam, wherein the leading end of a tubular web of thermoplastic film provided with a transverse weld seam at the end is intermittently moved over the support for the stack, severed from the web by a transverse cut at the spacing of the sack length, and the new web end formed by the cut is closed by a transverse weld seam, and wherein the following sacks likewise formed by transverse weld seams and transverse cuts are deposited on each other up to the desired stack height and the deposited sacks are held at their superposed open sides, as well as to an apparatus for performing this method.

In a known method of this kind, there is a danger that the superposed base weld seams in the stack will stick to each other or form a block so that it is later difficult to separate the bags or sacks from each other. To prevent the freshly formed weld seams of bags or sacks from adhering to each other when they are subsequently superposed to form stacks, it is known to take the individually welded bags or sacks away by a conveyor belt having a speed such that the individual bags lie on the conveyor belt at a spacing from each other. From this first conveyor belt, the bags are then transferred to a second conveyor belt running at a slower speed and on which the workpieces accumulate in a scale formation from which the stack is formed after the weld seams have cooled. This manner of forming stacks is possible only if the bags or sacks are of relatively stiff material and on the other hand sufficient factory space must be available for the conveyor belts.

It is therefore the problem of the present invention to provide a method of the aforementioned kind by which the sacks or bags can be formed into stacks directly after they are made without fear of the freshly formed weld seams adhering to each other.

According to the invention this problem is solved in that the individually deposited sacks are at a zone intermediate their ends and commencing with the first sack successively pulled into internested loops of which the depth decreases from sack to sack. According to the method of the invention, stacks can be formed in which the sack margins provided with the transverse weld seams are superposed in offset scale formation so that the welded regions will not be in contact and cannot adhere to each other.

The offset depositing of the bags or sacks in the stack can be maintained if the front zone of the finished stack is held behind the margins of the sacks which are superposed in overlapping scale formation and which are provided with transverse weld seams, and is transported away. The looped zone automatically flattens out during transport or can be smoothed out by rollers or the like.

If the method of the invention is to be used to form edge-aligned stacks, the loop of the uppermost sack in the finished stack can be pulled so low that all the loops are in internested contact even at the apex. By means of this deep formation of the loop of the uppermost sack, the projecting leading ends of the sacks are pulled into the stack.

An apparatus for performing the method of the invention comprising a pair of feed rollers for the web of tubular film, means for advancing the web end over a support or conveyor means for forming the stacking station, parallel means for transversely welding and transversely severing the web, of which the transverse welding means are behind the transverse cutting means in the direction of movement, and means for holding the stack-forming superposed sacks near their open edges is characterised according to the invention in that the stacking station comprises a transverse gap into which there can be inserted, after depositing each sack, an insert element which extends thereabove and which is provided with control means which, after each bag or sack is deposited, reduce the amount of its insertion by a distance corresponding to the length by which its leading end projects beyond the underlying sack.

Desirably, the gap is formed by two parallel rollers. The leading roller in the direction of feeding can be formed by the rear direction-changing drum of a conveyor belt for transporting the stack away. The insert element may be a bar having its ends secured to the piston rods of piston-cylinder units arranged vertically adjacent to the stack.

In a further embodiment of the invention, it is provided that the descent of the bar is limited by cam plates which have a spiral cam, are disposed laterally next to the stack and are intermittently rotatable through angular steps about a horizontal axis. One rotation of the cam corresponds to one stack formation.

One example of the invention will now be described in more detail with reference to the drawing in which the single FIGURE is a side elevation of the apparatus for forming stacked sacks.

A pair of feed rollers 2, 3 is provided for the intermittent advancing of the plastics web 1 of tubular film which, when making sacks or bags with side folds, may also be provided with side folds. The rollers 2, 3 are provided with circumferential grooves of which the base is indicated by the broken line 4 and into which rows of air jet tubes 5, 6 engage in the manner of a comb.

The tubular web 1 is passed between the air jet tubes 5 and 6 so that the leading end of the web advanced by the pair of feed rollers 2, 3 is carried by the air jet in stretched form between the opened welding jaws 7 and 8 and the upper and lower knife 9, 10 of the cutting tool by one sack length after the leading edge of the tubular film has been closed by a weld seam. The upper and lower knife 9, 10 is followed by a depresser 11 and a counterbearing 12 associated with the depresser, the depresser 11 consisting of an angle iron which can be actuated by a piston-cylinder unit 13. This angle iron is provided with recesses (not shown) so that, during its descent, the depresser passes through the rows of the needles 14 of a needle bar 15 and thereby pushes the heavy duty sacks onto the needles 14 with their opening edge. The counterbearing 12 limits the path of the depresser 11 which, as already mentioned, is moved up and down by the pneumatic piston-cylinder unit 13.

As the stack of heavy duty sacks grows, the counterbearing 12 is lowered in a manner not shown and the needle bar 15 is lowered by a piston-cylinder unit 16. As will be evident from the drawing, the needle bar 15 is associated with two spaced rollers of which the roller 18 at the same time constitutes a roller for a conveyor belt 19. Engageable in the gap defined by the rollers 17 and 18 there is a pull rod 20 which is guided at both ends by a respective piston-cylinder unit. The length of the pull rod is dimensioned so that it exceeds the maximum sack width by an amount such that the two piston cylinder units 21 as well as the two cam plates 22 can engage its ends. After each heavy duty sack is discharged, the pull rod 20 is moved out of its upper position (not shown) in which it does not impede the discharge of the individual heavy duty sacks, into the illustrated lower position so that a loop is formed. After each stroke, the cam plates are turned clockwise to a certain extent so that the depth of the loops in the individual heavy duty sacks becomes smaller as the stack grows. In this way one ensures that the individual sacks or the base seams of the individual sacks are disposed in a scale formation and cannot therefore adhere to each other.

After a stack is formed, the clamping jaw 23 is lowered onto the stack by piston-cylinder units 24 engaging same, so that the stack is pressed onto the conveyor belt 19. The piston-cylinder units 24 are secured to racks 25 which are guided in rails in a manner not shown and are displaceable by pinions 26. The pinions 26 are connected to the drive of the conveyor belt 19 so that the stack can be led away by the conveyor belt 19. In this case one obtains a stack in which the weld seams lie next to each other in scale formation.

If one wants to obtain an edge-aligned stack instead, the pull rod 20 is moved downwardly completely after the last sack of a stack has been placed thereon. A prerequisite for this is that the highest point of the cam plate 22 is turned out of the region of the pull rod 20.

It may also be mentioned that the cam plate 22 turns through 360° during the formation of one stack of sacks.

I claim:

1. A method of forming stacks from sacks each having at one end a base closed by a transverse weld seam, wherein the leading end of a tubular web of thermoplastic film provided with a transverse weld seam at the end is intermittently moved over the support for the stack, severed from the web by a transverse cut at the spacing of the sack length, and the new web end formed by the cut is closed by a transverse weld seam, and wherein the following sacks likewise formed by transverse weld seams and transverse cuts are deposited on each other up to the desired stack height and the deposited sacks are held at their superposed open sides, characterised in that, starting with the first sack, the individually deposited sacks are at a zone intermediate their ends successively pulled into internested loops of which the depth decreases from sack to sack.

2. A method according to claim 1, characterised in that the front zone of the finished stack is held behind the margins of the sacks which are superposed in overlapping scale formation and which are provided with transverse weld seams, and is transported away.

3. A method according to claim 1, characterised in that the loop of the uppermost sack in the finished stack is pulled so low that all the loops are in internested contact even at the apex.

4. Apparatus for forming stacks of sacks each having at one end a base closed by a transverse weld seam, comprising a pair of feed rollers for the web of tubular film, means for advancing the web end over a support or conveyor means forming the stacking station, parallel means for transversely welding and transversely severing the web, of which the transverse welding means are behind the transverse cutting means in the direction of movement, and means for holding the stack-forming superposed sacks near their open edges, characterised in that the stacking station comprises a transverse gap into which there can be inserted, after depositing each sack, an insert element which extends thereabove and which is provided with control means which, after each bag or sack is deposited, reduce the amount of its insertion by a distance corresponding to the length by which its leading end projects beyond the underlying sack.

5. Apparatus according to claim 4, characterised in that the gap is formed by two parallel rollers.

6. Apparatus according to claim 5, characterised in that the front roller in the feeding direction is formed by the rear direction-changing drum of a conveyor belt transporting the sack away.

7. Apparatus according to claim 4, characterised in that the insert element consists of a bar of which the ends are secured to the piston rods of piston-cylinder units vertically disposed adjacent to the stack.

8. Apparatus according to claim 7, characterised in that the descent of the bar is limited by cam plates which have a spiral cam and are intermittently rotatable through angular steps about a horizontal axis.

9. Apparatus according to claim 4, characterised in that near the front end of the stack there is a lowerable pressing member which is movable together with the conveyor means for transporting the stack away.

10. Apparatus according to claim 5, characterised in that the insert element consists of a bar of which the ends are secured to the piston rods of piston-cylinder units vertically disposed adjacent to the stack.

11. Apparatus according to claim 6, characterised in that the insert element consists of a bar of which the ends are secured to the piston rods of piston-cylinder units vertically disposed adjacent to the stack.

12. Apparatus according to claim 10, characterised in that the descent of the bar is limited by cam plates which have a spiral cam and are intermittently rotatable through angular steps about a horizontal axis.

13. Apparatus according to claim 11, characterised in that the descent of the bar is limited by cam plates which have a spiral cam and are intermittently rotatable through angular steps about a horizontal axis.

14. Apparatus according to claim 5, characterised in that near the front end of the stack there is a lowerable pressing member which is movable together with the conveyor means for transporting the stack away.

15. Apparatus according to claim 6, characterised in that near the front end of the stack there is a lowerable pressing member which is movable together with the conveyor means for transporting the stack away.

16. Apparatus according to claim 7, characterised in that near the front end of the stack there is a lowerable pressing member which is movable together with the conveyor means for transporting the stack away.

17. Apparatus according to claim 8, characterised in that near the front end of the stack there is a lowerable pressing member which is movable together with the conveyor means for transporting the stack away.

18. Apparatus according to claim 10, characterised in that near the front end of the stack there is a lowerable pressing member which is movable together with the conveyor means for transporting the stack away.

19. Apparatus according to claim 11, characterised in that near the front end of the stack there is a lowerable pressing member which is movable together with the conveyor means for transporting the stack away.

* * * * *